US006283648B1

(12) United States Patent
Miyajima

(10) Patent No.: US 6,283,648 B1
(45) Date of Patent: Sep. 4, 2001

(54) THERMAL HEAD CONTROL CIRCUIT AND THERMAL HEAD CONTROL METHOD PERMITTING MULTICOLOR PRINTING

(75) Inventor: Takeo Miyajima, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/197,941

(22) Filed: Nov. 23, 1998

(30) Foreign Application Priority Data

Nov. 28, 1997 (JP) ..... 9-344506

(51) Int. Cl.[7] ..... B41J 2/315
(52) U.S. Cl. ..... 400/120.01; 400/120.09
(58) Field of Search ..... 400/120, 120.01, 400/120.09; 346/76; 347/17

(56) References Cited

U.S. PATENT DOCUMENTS 4,641,147 * 2/1987 Sakura et al. ..... 346/76
4,983,054 1/1991 Nishiura ..... 400/120
5,365,257 * 11/1994 Minowa et al. ..... 346/76
5,706,043 * 1/1998 Okada et al. ..... 347/185

* cited by examiner

*Primary Examiner*—John S. Hilten
*Assistant Examiner*—Charles H. Nolan, Jr.
(74) *Attorney, Agent, or Firm*—Ostrolenk, Faber, Gerb & Soffen, LLP

(57) ABSTRACT

A thermal head control circuit and a thermal head control method according to the present invention are so configured as to set a state in which a limiting resistor is connected to a heating resistor element corresponding to data indicating color development in a lower temperature range, and set a state in which a limiting resistor is not connected to a heating resistor element corresponding to data indicating color development in a higher temperature range. Therefore, the calorific values of the heat resistor elements can be regulated even if the duration of electrification is kept constant and, where multicolor printing is to be accomplished, printing can be performed at constant speed all the time.

4 Claims, 4 Drawing Sheets

THERMAL HEAD CONTROL CIRCUIT AND THERMAL HEAD CONTROL METHOD PERMITTING MULTICOLOR PRINTING

BACKGROUND OF THE INVENTION

1. Field of the Invention

The present invention relates to a thermal head control circuit and a thermal head control method for controlling a thermal head for developing color on thermosensitive recording paper, and more particularly to a thermal head control circuit and a thermal head control method permitting multicolor printing.

2. Description of the Prior Art

FIG. 1 illustrates the configuration of a conventional thermal head control circuit. In the figure, a thermal head has a plurality each of heating resistor elements 600*a* to 600*c* and transistors 700*a* to 700*c*. A print control section 100 receives print information from a main control section, such as the control unit of a printer (not shown), supplies a head control section 200 with print data, indicating whether or not each dot on one line should be or need not be printed, as well as a latch signal S2. The head control section 200, in accordance with the print data, turns on or off the transistors 700*a* to 700*c* respectively connected to the heating resistor elements 600*a* to 600*c* constituting individual dots of the thermal head.

Next will be described the operation of this prior art thermal head control circuit.

The print control section 100, having completed outputting of print data indicating individual dots on one line to the head control section 200, supplies the latch signal S2 to the head control section 200. The head control section 200 has a shift register for shifting, for instance, print data supplied from the print control section 100, latches the print data in accordance with the latch signal S2, and outputs them in parallel. This causes the transistor, out of the transistors 700*a* to 700*c*, corresponding to each dot supposed to be printed out of the print data, to be turned on. A current flows to a heating resistor element through the transistor turned on, and the heating resistor element emits heat. Accordingly, each dot to be printed on the thermosensitive recording paper is printed.

The following description refers to a case in which such a thermal head control circuit is applied to a small size thermal printer and dichroic printing is accomplished. Dichroic printing is usually accomplished by varying color development according to a difference in calorific value (energy) given to thermosensitive recording paper.

The calorific value (energy) is proportional to the duration of the electrification of the heating resistor elements.

Therefore, when second color development is to be accomplished in dichroic printing, a greater calorific value needs to be applied than in first color development, and the transistors 700*a* to 700*c* need to be kept electrified for a longer duration. In this case, where high speed printing is to be done, the duration of electrification may prove too long to be accommodated in one line step of recording paper feeding. This problem can be solved, as described in the U.S. Pat. No. 4,983,054, by reducing the paper feeding speed for the second color development.

Incidentally, not only in dichroic printing, color development can be controlled by regulating the duration of electrification in usual adjustment of density as well.

The conventional thermal head control circuit, being composed as described above, involves the problem that the printing speed is reduced especially when printing in multiple colors. Moreover, when multicolor printing has to be done on a dot-by-dot basis within one line, a plurality of different durations of electrification should be handled, resulting in complexity of processing by the head control section.

SUMMARY OF THE INVENTION

An object of the present invention is to provide a thermal head control circuit and a thermal head control method permitting, where multicolor printing is to be performed, printing at constant speed all the time without suffering a drop in printing speed.

According to the invention, there is provided a thermal head control circuit for developing at least two colors on a thermosensitive paper by providing heat on the thermosensitive paper on a dot-by-dot basis. The thermal head control circuit is provided with a thermal head having a plurality of heating resistor elements, for providing heat on the thermosensitive paper on the dot-by-dot basis; a print data circuit for generating print data indicating whether or not each of the individual heating resistor element in the thermal head is to be electrified irrespective of the color to be developed; a color development data circuit for generating color development data indicating which color should be developed on the dot-by-dot basis; an electrifying circuit for electrifying each of the individual heating resistor element according to the print data; and a current switching circuit for switching a magnitude of current flowing to the electrifying circuit according to the color development data to develop the colors on the thermosensitive paper.

The current switching circuit has the current limiting element for limiting the current flowing through the respective heating resistor elements in the thermal head, and a control circuit responsive to the color development data for controlling whether or not each current limiting element should be electrically connected to the corresponding heating resistor element.

Also the current switching circuit may has the current limiting elements for limiting the currents flowing through the respective heating resistor elements in the thermal head, and a control circuit responsive to the color development data for controlling the switching of the current limiting elements to be electrically connected to the corresponding heating resistor element.

A thermal head control method according to the invention, for controlling a thermal head to print on thermosensitive recording paper permitting dichroic printing, is a method to prepare color development pattern data indicating color development for each of dots constituting one line, set a state in which a limiting resistor is connected to a heating resistor element corresponding to data indicating color development in a lower temperature range in a color development data pattern, and set a state in which a limiting resistor is not connected to a heating resistor element corresponding to data indicating color development in a higher temperature range in the color development data pattern.

As described above, according to the present invention, since the thermal head control circuit and the thermal head control method are so configured as to set a state in which a limiting resistor is connected to a heating resistor element corresponding to data indicating color development in a lower temperature range in a color development data pattern, and set a state in which a limiting resistor is not connected to a heating resistor element corresponding to data indicating color development in a higher temperature range in the color development data pattern, the calorific values of the heat resistor elements can be regulated even if the duration of electrification is kept constant, multicolor printing can be accomplished at constant speed all the time.

DETAILED DESCRIPTION OF THE PREFERRED ELEMENTS

Figure 2:
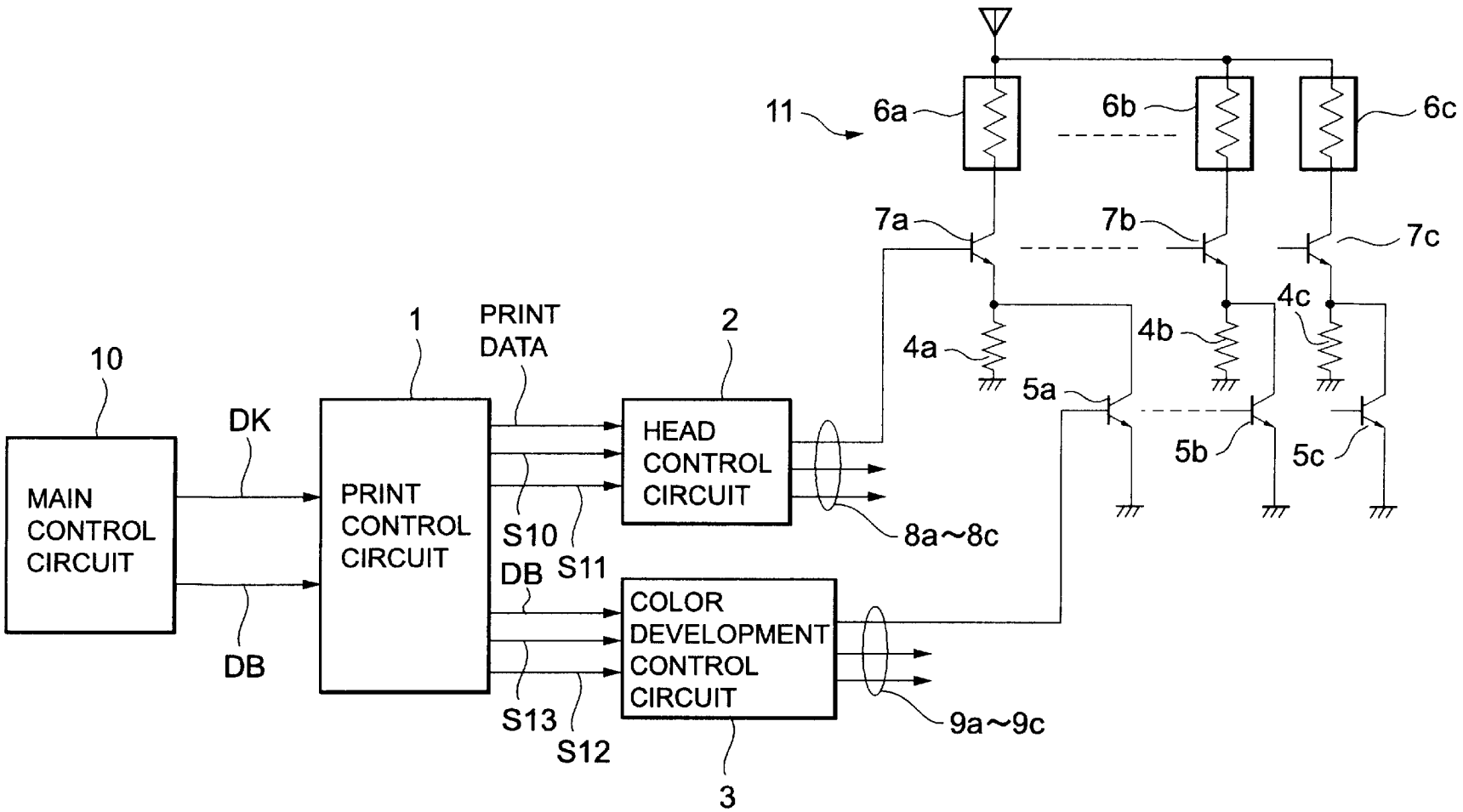
FIG. 2 is a circuit diagram schematically illustrating the configuration of a thermal head control circuit, which is a first preferred embodiment of the present invention.

FIG. 2 is a circuit diagram schematically illustrating the configuration of a thermal head control circuit, which is a first preferred embodiment of the present invention. The thermal head control circuit in this first embodiment carries out recording by developing either of two colors, black and blue, for each dot on thermosensitive recording paper. Multicolor printing is accomplished by causing thermosensitive paper to develop different colors according to differences in the calorific value that is provided. In the following description, it is supposed that the color developed in a range where the calorific value given to thermosensitive paper is lower is black and that developed in a range where the calorific value given to thermosensitive paper is higher is blue.

In FIG. 2, a thermal head 11 has a plurality of heating resistor elements 6*a* to 6*c* and transistors (NPN transistors) 7*a* to 7*c* for driving them respectively.

A main control circuit 10 generates print information on each dot to be recorded on thermosensitive recording paper by the thermal head 11, and supplies it to a print control circuit 1. The print information has black pattern data DK indicating whether or not to print black, and blue pattern data DB indicating whether or not to print blue. The main control circuit 10 supplies the black pattern data DK and the blue pattern data DB in parallel for each dot.

The print control circuit 1 supplies a head control circuit 2 with print data D1 indicating whether or not each dot on one line is to be printed. A print datum D1, indicating whether either of the two colors, black and blue, is to be printed or nothing is to be printed at all, is generated by calculating the logical sum (OR) of a black pattern datum DK and a blue pattern datum DB.

The head control circuit 2 turns on or off, in accordance with print data D1, the transistors 7*a* to 7*c* connected to thermal resistor elements 6*a* to 6*c* each constituting a dot of the thermal head 11.

More specifically the head control circuit 2 has a shift register for shifting, in synchronism with a transfer pulse S10, the print data D1 supplied from the print control circuit 1, latches that print data in accordance with a latch signal S11, and supplies print data 8*a* to 8*c* to the transistors 6*a* to 6*c*, respectively, in parallel.

The print control circuit 1 supplies, in synchronism with a transfer pulse S12, the blue pattern data DB indicating the color of each dot on one line to a color development control circuit 3. The color development control circuit 3 has a shift register for shifting, in synchronism with a transfer pulse S12, the blue pattern datum DB supplied from the print control circuit 1, latches that blue pattern datum DB in accordance with a latch signal S13, and supplies blue data 9*a* to 9*c* to transistors Sa to 5*c*, respectively, in parallel. In this instance, the print data 8*a* to 8*c* and the blue data 9*a* to 9*c* are generated simultaneously.

The transistors 5*a* to Sc constitute current switching circuits connected to the respective connection points between the emitters of the transistors 7*a* to 7*c* and current limiting elements 4*a* to 4*c*. The emitters of the transistors 5*a* to 5*c* are grounded, and these transistors 5*a* to 5*c* are controlled for turning on or off by the color development control circuit 3.

Next will be described the operation of the circuit illustrated in FIG. 2.

The main control circuit 10 generates print information consisting of black pattern data DK and blue pattern data DB at an instruction to start printing. As the print information is supplied from the main control circuit 10, the print control circuit 1 supplies print data D1 to the head control circuit 2 and at the same time blue pattern data DB to the color development control circuit 3.

The print control circuit 1 supplies the transfer pulse S10 and the latch signal S11 to the head control circuit 2 and at the same time the transfer pulse S12 and the latch signal S13 to the color development control circuit 3.

The head control circuit 2 latches the print data 1 in accordance with the latch signal S11, and turns on those transistors, out of the transistors 7*a* to 7*c*, corresponding to the dots required to be printed according to the print data.

The color development control circuit 3 latches the blue pattern data DB in accordance with the latch signal S13, and turns on those transistors, out of the transistors 5*a* to 5*c*, corresponding to the dots to be printed in blue, the color to be developed in the higher temperature range, according to a color development data pattern. It also turns off those transistors, out of the transistors 5*a* to 5*c*, corresponding to the dots to be printed in black, the color to be developed in the lower temperature range.

Whereas currents from a power source flow to heating resistor elements corresponding to dots to be printed, their amperages are switched by the color development control circuit 3. Since those transistors, out of the transistors 5*a* to 5*c*, corresponding to the dots to be printed in blue, the color to be developed in the higher temperature range, are on, greater currents flow to the heating resistor elements corresponding to these dots. Conversely, since those transistors, out of the transistors 5*a* to 5*c*, corresponding to the dots to be printed in black, the color to be developed in the lower temperature range, smaller currents flow to the heating resistor elements corresponding to these dots.

Since greater currents flow to the heating resistor elements corresponding to dots to be printed in blue and smaller currents flow those corresponding to dots to be printed in black, the calorific values of the heating resistor elements corresponding to dots to be printed in blue are greater, and those of the heating resistor elements corresponding to dots to be printed in black are smaller, even if the duration of electrification is constant.

Therefore, printing in blue and printing in black can be accomplished in an equal length of time. Accordingly, the printing speed can be kept constant all the time, resulting in reductions in noise and unevenness in paper feeding both attributable to fluctuations in paper feed speed. Furthermore, as the duration of electrification can be kept constant irrespective of the color to be developed, electrification control by the head control circuit 2 can be simplified.

The duration of electrification is set so as to make possible complete development of blue color on the thermosensitive recording paper to be used. The resistances of the current limiting resistors 4*a* to 4*c* are selected so as to allow currents which would result in development of black color on the thermosensitive paper in that set duration of electrification to flow to the heating resistor elements 6*a* to 6*c*.

In FIG. 2, the print control circuit 1 may be provided with a shift register for shifting print data D1 by a single line equivalent and another shift register for shifting blue pattern data DB by a single line equivalent. In this case, the head control circuit 2 and the color development control circuit 3 have only to latch the print data D1 and the blue pattern data DB, respectively, and the main control circuit 10 has only to give a print start instruction to the print control circuit 1.

Figure 3:
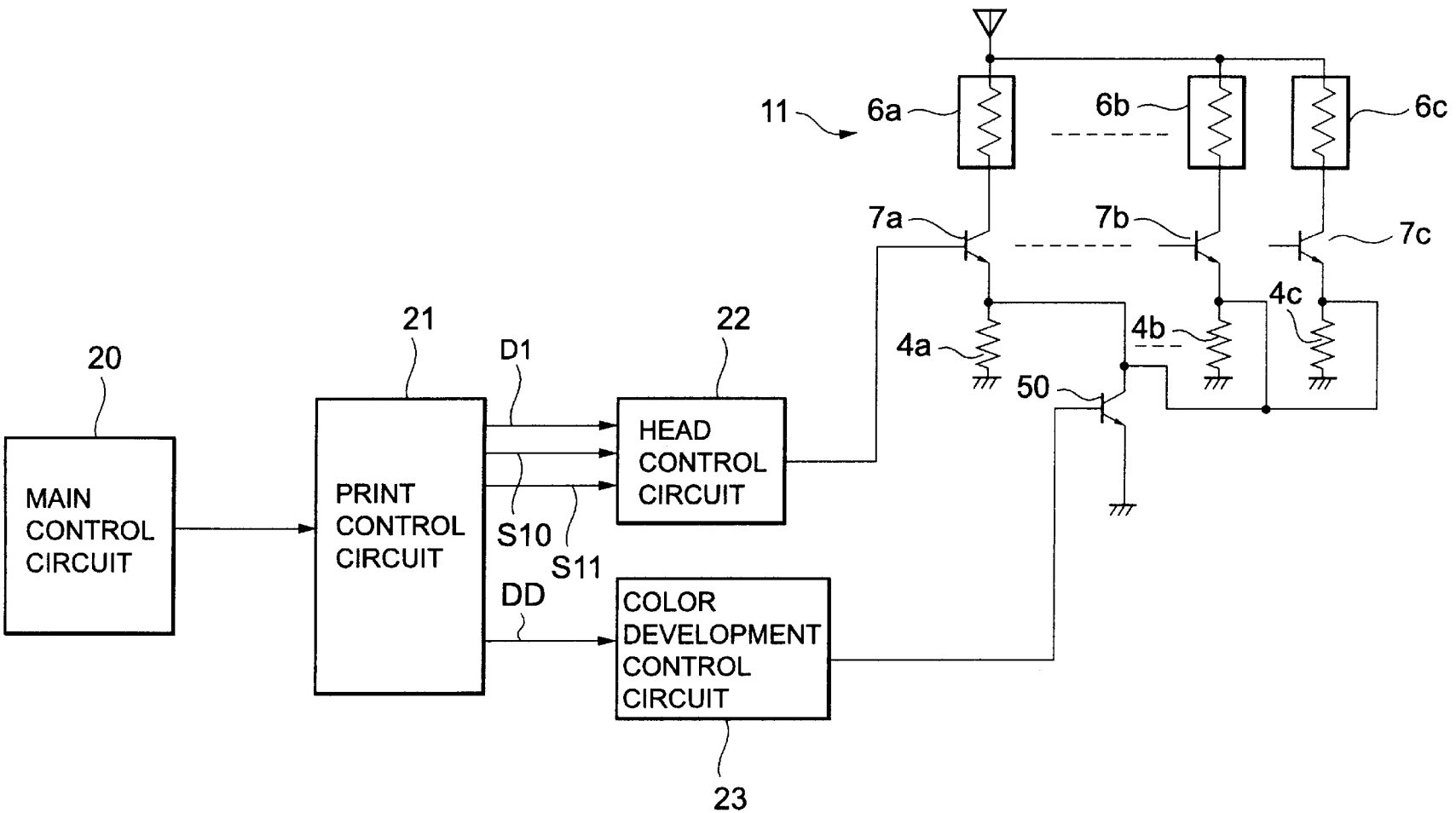
FIG. 3 is a circuit diagram schematically illustrating the configuration of a thermal head control circuit, which is a second preferred embodiment of the invention.

FIG. 3 is a circuit diagram schematically illustrating a thermal head control circuit, which is a second preferred embodiment of the present invention. In FIG. 3, the thermal head control circuit has a main control circuit 20, a print control circuit 21, a head control circuit 22, which is the same as the head control circuit 2 in FIG. 2, a color development control circuit 23, and a thermal head 11.

In the thermal head control circuit of FIG. 2, blue and black dots are coexistent on each line. However, where printing in two colors need not be done on a dot-by-dot basis but needs to be done only on a line-by-line basis, one transistor 50 for leading the currents flowing to the heating resistor elements 6*a* to 6*c* to common grounding would suffice.

In this instance, the print control circuit 1 recognizes the color developed on each line from print information from the main control circuit 20, and supplies a color development datum DD indicating that color to the color development control circuit 23 on a line-by-line basis. The color development control circuit 23 will turn on the transistor 5 if the color development datum DD designates blue, or turn off the transistor 5 if the color development datum DD designates black.

Incidentally, NPN transistors are used as switching elements for driving the heating resistor elements 6*a* to 6*c* and NPN transistors are also used as switching elements for determining whether or not the limiting resistor resistors 4*a* to 4*c* are to be used in both of the above-described embodiments, other elements may as well be used.

Figure 4:
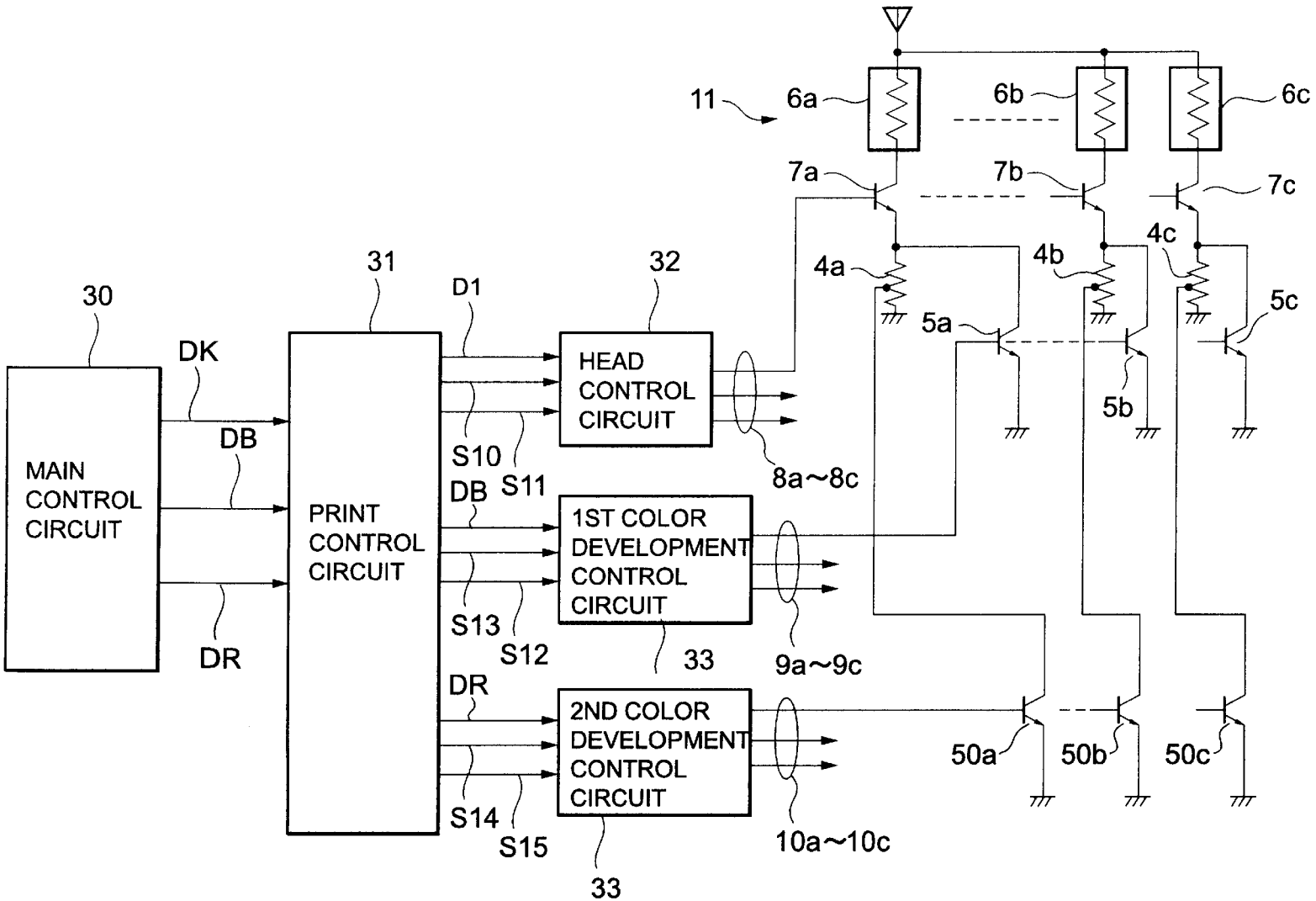
FIG. 4 is a circuit diagram schematically illustrating the configuration of a thermal head control circuit, which is a third preferred embodiment of the invention.

FIG. 4 is a circuit diagram schematically illustrating a thermal head control circuit, which is a third preferred embodiment of the present invention.

The thermal head control circuit, which is the third embodiment, develops three colors including black, blue and red on thermosensitive recording paper on a dot-by-dot basis to perform recording. The color developed in a range where the calorific value given to the thermosensitive paper is the lowest is black; that developed in a range where the calorific value is higher than that is red; and that developed in a range where the calorific value is higher than in the red developing range is blue.

Figure 1:
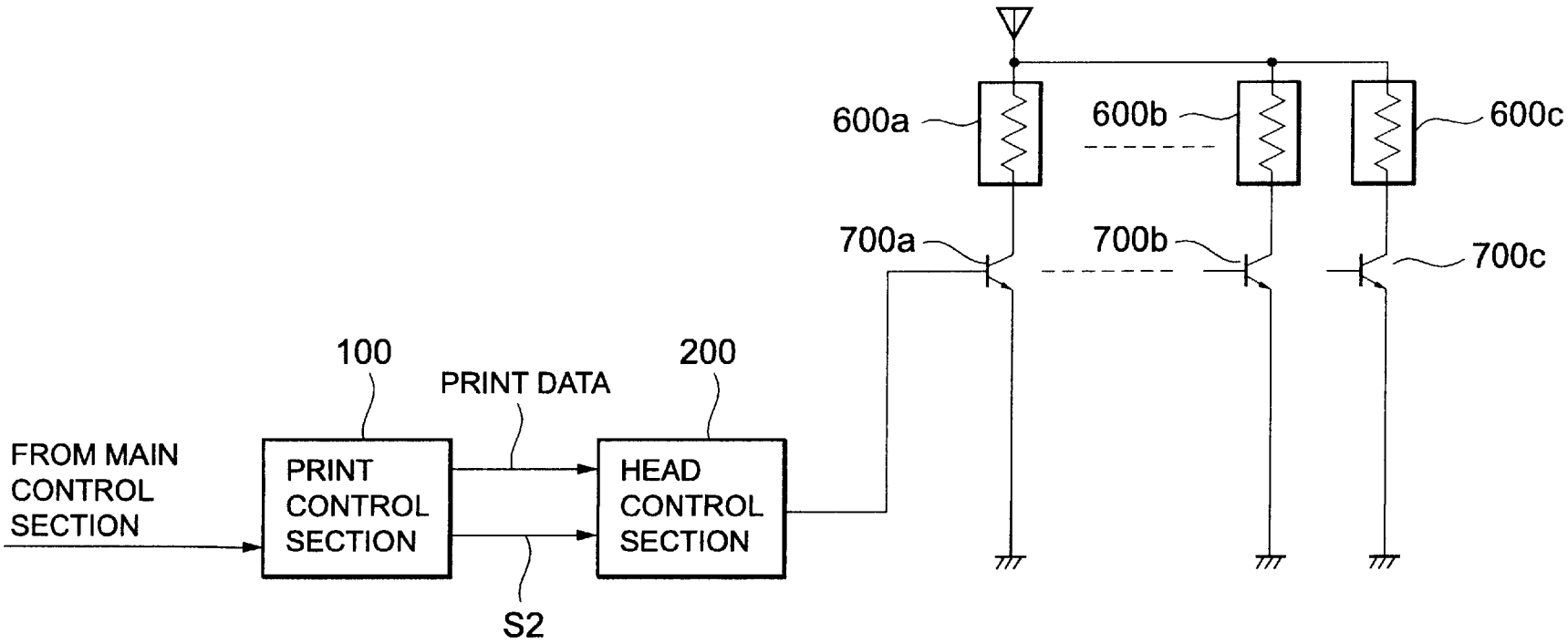
FIG.1 PRIOR ART
FIG. 1 is a circuit diagram schematically illustrating the configuration of a conventional thermal head control circuit.

The thermal head control circuit of FIG. 4 is configured by adding another color development control circuit 34 for red (a second color development control circuit) and transistors 50*a* to 50*c* to the thermal head control circuit of FIG. 1. The transistors 50*a* to 50*c* are connected on the way of the current limiting resistors 4*a* to 4*c*, respectively. Therefore, the current limiting resistors 4*a* to 4*c* are divided to a first resistance (full resistance value) and the second resistance (half resistance value).

A main control circuit 30 generates, at an instruction to start printing, print information including black pattern data DK, blue pattern data DB and red pattern data DR. The red pattern data DR indicate whether or not red is to be printed on the thermosensitive recording paper.

A print control circuit 31, into which print information is entered from the main control circuit 30, supplies print data D1 to a head control circuit 32, and at the same time supplies blue pattern data to a first color development control circuit 33 and red pattern data to the second color development control circuit 34. The data D1 here are print/not-print data indicating whether printing is to be done in black, red or blue or not to be done at all.

The head control circuit 32 and the first color development control circuit 32 are the same as the head control circuit 2 and the color development control circuit 3, respectively, in FIG. 2.

The second color development control circuit 34 has a shift register for shifting, in synchronism with a transfer pulse S14, the red pattern datum DR supplied from the print control circuit 31, latches that red pattern datum DR in accordance with a latch signal S15, and supplies red data 10*a* to 10*c* to transistors 50*a* to 50*c*, respectively, in parallel. In this instance, the print data 8*a* to 8*c*, the blue data 9*a* to 9*c*, and the red data 10*a* to 10*c* are generated simultaneously.

Therefore, the second color development control circuit 34 turns on those transistors, out of the transistors 50*a* to 50*c*, corresponding to the dots to be printed in red, the color to be developed in the temperature range higher than that for black and lower than that for blue, according to a color development data pattern. It also turns off those transistors, out of the transistors 50*a* to 50*c*, corresponding to the dots not to be printed in red (the dots to be printed in black or blue).

Since those transistors, out of the transistors 5*a* to 5*c*, corresponding to the dots to be printed in blue, the color to be developed in the higher temperature range according to the color development data pattern, are on, greater currents flow to the heating resistor elements corresponding to these dots. Conversely, since both the transistors 5*a* to 5*c* and the transistors 50*a* to 50*c* are off, smaller currents flow to the heating resistor elements corresponding to the dots to be printed in black, the color to be developed in the lower temperature range.

Accordingly, even though the duration of electrification is constant, a heating resistor element corresponding to dots to be printed in blue emits a greater calorific value, a heating resistor element corresponding to dots to be printed in red emits a calorific value smaller than that, and a heating resistor element corresponding to dots to be printed in black emits the smallest calorific value.

Therefore, printing in blue, printing in red and printing in black can be accomplished in an equal length of time. Accordingly, the printing speed can be kept constant all the time, resulting in reductions in noise and unevenness in paper feeding both attributable to fluctuations in paper feed speed. Furthermore, as the duration of electrification can be kept constant irrespective of the color to be developed, electrification control by the head control circuit can be simplified.

What is claimed is:

1. A thermal head control circuit for developing at least two colors on a thermosensitive paper by providing heat on said thermosensitive paper on a dot-by-dot basis, comprising:

a thermal head having a plurality of heating resistor elements, for providing heat on said thermosensitive paper on the dot-by-dot basis;

a print data circuit for generating print data indicating whether or not each of the individual heating resistor element in said thermal head is to be electrified irrespective of the color to be developed, a color development data circuit for generating color development data indicating which color should be developed on the dot-by-dot basis;

an electrifying circuit for electrifying each of the individual heating resistor element according tc said print data; and a current switching circuit for switching a magnitude of current flowing to said electrifying circuit according to said color development data to develop the colors on said thermosensitive paper, said current switching circuit comprising:

a current limiting element for limiting the current flowing through the respective heating resistor elements in the thermal head, and a control circuit responsive to said color development data for controlling whether or not each current limiting element should be electrically connected to the corresponding heating resistor element.

2. A thermal head control circuit, as claimed in claim 1, wherein said electrifying circuit has switching elements for electrically connecting said current limiting elements to the heating resistor elements.

3. A thermal head control circuit for developing at least two colors on a thermosensitive paper by providing heat on said thermosensitive paper on a dot-by-dot basis, comprising:

a thermal head having a plurality of heating resistor elements, for providing heat on said thermosensitive paper on the dot-by-dot basis;

a print data circuit for generating print data indicating whether or not each of the individual heating resistor element in said thermal head is to be electrified irrespective of the color to be developed, a color development data circuit for generating color development data indicating which color should be developed on the dot-by-dot basis;

an electrifying circuit for electrifying each of the individual heating resistor element according to said print data; and a current switching circuit for switching a magnitude of current flowing to said electrifying circuit according to said color development data to develop the colors on said thermosensitive paper, said current switching circuit comprising:

current limiting elements for limiting the currents flowing through the respective heating resistor elements in the thermal head, and a control circuit responsive to said color development data for controlling the switching of the current limiting elements to be electrically connected to the corresponding heating resistor element.

4. A thermal head control circuit, as claimed in claim 1, wherein:

said electrifying circuit has one switching element for electrically connecting the current limiting elements to the heating resistor elements;

said color development control circuit generates color development data indicating which color the line to be printed is in; and said switching control element determines whether or not said switching element is to be in a state of electrically connecting the current limiting elements to the heating resistor elements according to said color development data.

* * * * *